US009226066B2

(12) United States Patent
Ohta et al.

(10) Patent No.: US 9,226,066 B2
(45) Date of Patent: Dec. 29, 2015

(54) ACTIVE VIBRATION NOISE CONTROL DEVICE

(75) Inventors: Yoshiki Ohta, Sakada (JP); Manabu Nohara, Tsurugashima (JP); Yusuke Soga, Kawasaki (JP); Shin Hasegawa, Kawagoe (JP); Hisashi Kihara, Tsurugashima (JP)

(73) Assignee: PIONEER CORPORATION, Kanagawa (JP)

( * ) Notice: Subject to any disclaimer, the term of this patent is extended or adjusted under 35 U.S.C. 154(b) by 494 days.

(21) Appl. No.: 13/640,244

(22) PCT Filed: Apr. 9, 2010

(86) PCT No.: PCT/JP2010/056424

§ 371 (c)(1),
(2), (4) Date: Nov. 5, 2012

(87) PCT Pub. No.: WO2011/125216

PCT Pub. Date: Oct. 13, 2011

(65) Prior Publication Data

US 2013/0195282 A1 Aug. 1, 2013

(51) Int. Cl.

| | |
|---|---|
| ***G10K 11/16*** | (2006.01) |
| ***H04R 3/00*** | (2006.01) |
| ***G10K 11/178*** | (2006.01) |

(52) U.S. Cl.

CPC ..... *H04R 3/002* (2013.01); *G10K 11/1782* (2013.01); *G10K 2210/3016* (2013.01); *G10K 2210/3022* (2013.01); *G10K 2210/3057* (2013.01)

(58) Field of Classification Search

CPC ..... G10K 2210/12; G10K 2210/121; G10K 2210/128; G10K 2210/1282; G10K 2210/3016; G10K 2210/3022; G10K 2210/3053; G10K 2210/3055; G10K 2210/3057

USPC ..... 381/71.1, 71.2, 71.4, 71.11

See application file for complete search history.

(56) References Cited

U.S. PATENT DOCUMENTS

| | | | | |
|---|---|---|---|---|
| 5,337,365 | A * | 8/1994 | Hamabe et al. | 381/71.12 |
| 2007/0038441 | A1 | 2/2007 | Inoue et al. | |

FOREIGN PATENT DOCUMENTS

| | | |
|---|---|---|
| JP | 2007-047367 | 2/2007 |
| JP | 2007-272008 | 10/2007 |
| JP | 2008-247279 | 10/2008 |
| JP | 4262703 | 2/2009 |

OTHER PUBLICATIONS

International Search Report, PCT/JP2010/056424, May 18, 2010.

* cited by examiner

*Primary Examiner* — Duc Nguyen
*Assistant Examiner* — Kile Blair
(74) *Attorney, Agent, or Firm* — Young & Thompson

(57) ABSTRACT

An active vibration noise control device is preferably used for canceling a vibration noise by making a speaker generate a control sound. Concretely, the active vibration noise control device includes an attenuating unit which attenuates a control signal generated by an adaptive notch filter, and provides the attenuated control signal to the speaker, when amplitude of a filter coefficient is larger than a threshold. Therefore, it is possible to suppress continuous ups and downs of the filter coefficient during an occurrence of an abnormality. Hence, it becomes possible to appropriately suppress an occurrence of a cyclic abnormal sound and an increase in the vibration noise during the occurrence of the abnormality.

18 Claims, 8 Drawing Sheets

ACTIVE VIBRATION NOISE CONTROL DEVICE

TECHNICAL FIELD

The present invention relates to a technical field for actively controlling a vibration noise by using an adaptive notch filter.

BACKGROUND TECHNIQUE

Conventionally, there is proposed an active vibration noise control device for controlling an engine sound heard in a vehicle interior by a controlled sound output from a speaker so as to decrease the engine sound at a position of passenger's ear. Concretely, noticing that a vibration noise in a vehicle interior is generated in synchronization with a revolution of an output axis of an engine, there is proposed a technique for canceling the noise in the vehicle interior on the basis of the revolution of the output axis of the engine by using an adaptive notch filter so that the vehicle interior becomes silent.

This kind of technique is proposed in Patent Reference 1, for example. In Patent Reference 1, there is proposed an active vibration noise control device for fading a control sound out when a filter coefficient is larger than an upper limit (first threshold) predetermined number of times, and for starting an adaptive controlling process again when the filter coefficient is smaller than a lower limit (second threshold). The technique aims to prevent an occurrence of an abnormal sound which occurs when a sound detector (for example microphone) is covered.

Additionally, there is disclosed a technique related to the present invention in Patent Reference-2.

PRIOR ART REFERENCE

Patent Reference

Patent Reference-1: Japanese Patent No. 4262703

Patent Reference-2: Japanese Patent Application Laid-open under No. 2007-272008

DISCLOSURE OF INVENTION

Problem to be Solved by the Invention

However, by the technique described in Patent Reference-1, when a error (specifically, a phase error) of a transfer function constantly occurs due to a secular change of the speaker, there is a possibility that continuous ups and downs of the filter coefficient between the first threshold and the second threshold occur, and that a cyclic abnormal sound is generated. Therefore, there is a possibility that an error signal detected by the microphone increases (in other words, the vibration noise increases). In Patent Reference-2, the above-mentioned problem and a method for solving the said problem are not described.

The present invention has been achieved in order to solve the above problem. It is an object of the present invention to provide an active vibration noise control device which can appropriately suppress an occurrence of a cyclic abnormal sound and an increase in a vibration noise during an abnormal behavior.

Means for Solving the Problem

In the invention according to claim 1, an active vibration noise control device for canceling a vibration noise by making a speaker output a control sound, includes: a basic signal generating unit which generates a basic signal based on a vibration noise frequency generated by a vibration noise source; an adaptive notch filter which generates a control signal provided to the speaker by applying a filter coefficient to the basic signal, in order to make the speaker generate the control sound so that the vibration noise generated by the vibration noise source is canceled; a microphone which detects a cancellation error between the vibration noise and the control sound, and outputs an error signal; a reference signal generating unit which generates a reference signal from the basic signal based on a transfer function from the speaker to the microphone; a filter coefficient updating unit which updates the filter coefficient used by the adaptive notch filter based on the error signal and the reference signal so as to minimize the error signal; an amplitude calculating unit which calculates an amplitude of the filter coefficient updated by the filter coefficient updating unit; and an attenuating unit which attenuates the control signal generated by the adaptive notch filter, and provides the attenuated control signal to the speaker, when the amplitude calculated by the amplitude calculating unit is larger than a threshold.

DETAILED DESCRIPTION OF THE PREFERRED EMBODIMENTS

Figure 1:
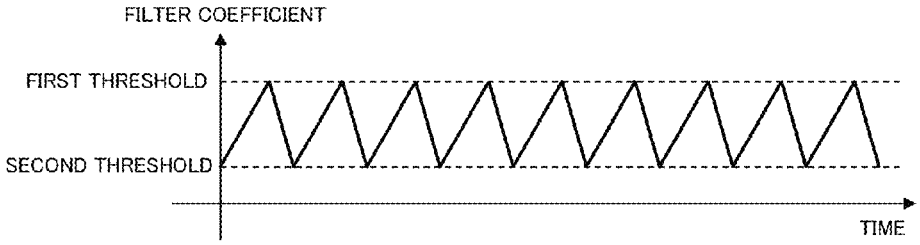
FIG. 1 shows a diagram for explaining a problem of a comparative example.

According to one aspect of the present invention, there is provided for canceling a vibration noise by making a speaker output a control sound, including: a basic signal generating unit which generates a basic signal based on a vibration noise frequency generated by a vibration noise source; an adaptive notch filter which generates a control signal provided to the speaker by applying a filter coefficient to the basic signal, in order to make the speaker generate the control sound so that the vibration noise generated by the vibration noise source is canceled; a microphone which detects a cancellation error between the vibration noise and the control sound, and outputs an error signal; a reference signal generating unit which generates a reference signal from the basic signal based on a transfer function from the speaker to the microphone; a filter coefficient updating unit which updates the filter coefficient used by the adaptive notch filter based on the error signal and the reference signal so as to minimize the error signal; an amplitude calculating unit which calculates an amplitude of the filter coefficient updated by the filter coefficient updating unit; and an attenuating unit which attenuates the control signal generated by the adaptive notch filter, and provides the attenuated control signal to the speaker, when the amplitude calculated by the amplitude calculating unit is larger than a threshold.

The above active vibration noise control device is preferably used for canceling the vibration noise (for example, vibration noise from engine) by making the speaker generate the control sound. The basic signal generating unit generates the basic signal based on the vibration noise frequency generated by the vibration noise source. The adaptive notch filter generates the control signal provided to the speaker by applying the filter coefficient to the basic signal. The microphone detects the cancellation error between the vibration noise and the control sound, and outputs the error signal. The reference signal generating unit generates the reference signal from the basic signal based on the transfer function from the speaker to the microphone. The filter coefficient updating unit updates the filter coefficient used by the adaptive notch filter so as to minimize the error signal. The amplitude calculating unit calculates the amplitude of the filter coefficient updated by the filter coefficient updating unit. For example, the amplitude calculating unit calculates the amplitude based on a sum of squares of a real part and an imaginary part of the filter coefficient.

When the amplitude calculated by the amplitude calculating unit is larger than the threshold, the attenuating unit attenuates the control signal generated by the adaptive notch filter, and provides the attenuated control signal to the speaker. Concretely, when a transfer function error occurs (namely, when an abnormality occurs), the attenuating unit attenuates the control signal generated by the adaptive notch filter. In other words, the attenuating unit makes a volume of the control sound smaller. Therefore, since a change of the filter coefficient becomes smaller (namely, an update rate becomes slower), the filter coefficient is maintained at a relatively large value. So, it is possible to suppress continuous ups and downs of the filter coefficient during the occurrence of the abnormality. Hence, by the above active vibration noise control device, it becomes possible to appropriately suppress the occurrence of the cyclic abnormal sound and the increase in the vibration noise during the occurrence of the abnormality.

In another manner of the above active vibration noise control device, the attenuating unit sets a limit of an attenuating degree of the control signal, and attenuates the control signal in a range corresponding to the limit.

In the above manner, the attenuating unit sets the limit of the attenuating degree of the control signal in order to suppress such an attenuation that the control signal becomes smaller than the limit. Namely, the attenuating unit restricts the control signal so that the volume of the control sound does not become smaller than a predetermined amount. Therefore, it is possible to ensure a clue (i.e., control sound) to distinguishing the normal from the abnormality, and it becomes possible to appropriately determine the normal and the abnormality.

In a preferred example of the above active vibration noise control device, the attenuating unit includes a attenuation ratio setting unit which sets an attenuation ratio indicating a ratio of the attenuated control signal to the control signal generated by the adaptive notch filter, and the attenuating unit attenuates the control signal based on the attenuation ratio set by the attenuation ratio setting unit, and the attenuation ratio setting unit decreases the attenuation ratio when the amplitude is larger than the threshold, and the attenuation ratio setting unit uses a lower limit of the attenuation ratio corresponding to the limit of the attenuating degree of the control signal, and sets the attenuation ratio to the lower limit when the attenuation ratio becomes smaller than the lower limit. Therefore, it is possible to appropriately prevent the volume of the control sound from decreasing too much.

Additionally, in a preferred example of the above active vibration noise control device, the attenuation ratio setting unit increases the attenuation ratio when the amplitude becomes equal to or smaller than the threshold, and sets the attenuation ratio to "1" when the attenuation ratio becomes larger than "1". Therefore, when the state is switched from the abnormality to the normal, it becomes possible to appropriately perform a recovery operation.

In another manner of the above active vibration noise control device, the threshold is set based on a maximum value of the amplitude which is obtained in such a situation that an error between the transfer function used by the reference signal generating unit and an actual transfer function from the speaker to the microphone does not occur. Therefore, it is possible to appropriately determine the normal and the abnormality based on a relationship between the amplitude of the filter coefficient and the threshold. For example, it is possible to appropriately prevent such a wrong determination that the abnormality occurs during the normal.

Preferably, the threshold is at least larger than the maximum value, and a difference between the threshold and the maximum value is equal to or smaller than a predetermined value. By determining the amplitude of the filter coefficient by using the above threshold, it is possible to appropriately determine the normal and the abnormality, and to appropriately suppress the increase in the error signal at the time of the recovery.

In another manner, the above active vibration noise control device further includes a unit which changes the threshold in accordance with the vibration noise frequency. According the manner, in consideration of such a tendency that a maximum value of the amplitude of the filter coefficient during the normal changes in accordance with a frequency band of the vibration noise, it is possible to appropriately change the threshold for determining the amplitude of the filter coefficient.

Embodiment

A preferred embodiment of the present invention will be explained hereinafter with reference to the drawings.

Basic Concept

First, a description will be given of a basic concept of an embodiment.

Generally, the active vibration noise control device uses the transfer function from the speaker to the microphone when the reference signal is calculated. The transfer function is preliminarily set, and the transfer function is not basically changed. However, there is a tendency that an actual transfer function of the sound field from the speaker to the microphone constantly changes. For example, the actual transfer function tends to change in accordance with a secular change of the speaker, passengers and a cargo. Additionally, the actual transfer function tends to change when the microphone is covered with a hand. When the actual transfer function changes, an error (specifically, a phase error) between the preliminarily set transfer function and the actual transfer function occurs. Then, when the error between the transfer functions occurs, the filter coefficient tends to diverge. Namely, the adaptive notch filter tends to diverge.

Hereinafter, the above error between the transfer functions is referred to as "transfer function error". Additionally, in the specification, such a case that the transfer function error occurs is represented as "during an occurrence of an abnormality", or "during an abnormal behavior", or "during an abnormality". Furthermore, in the specification, such a case that the transfer function error does not occur is represented as "during a normal behavior", or "during a normal".

Here, a description will be given of a problem of the above technique (hereinafter referred to as "comparative example") described in Patent Reference-1, with reference to FIG. 1. When the first filter coefficient of the adaptive notch filter becomes larger than the first threshold, the active vibration noise control device in the comparative example sets the filter coefficient to the first threshold. When the filter coefficient sequentially becomes larger than the first threshold the predetermined number of times, the active vibration noise control device in the comparative example performs the forgetting process for generating the cancellation sound by using the second filter coefficient obtained by sequentially multiplying the first filter coefficient before the update by the predetermined value being smaller than 1. Additionally, during the generation of the cancellation sound, when the second filter coefficient becomes smaller than the second threshold being smaller than the first threshold, the active vibration noise control device in the comparative example starts the adaptive controlling process again, and generates the cancellation sound by using the first filter coefficient which is sequentially updated so as to minimize the error sound. The comparative example aims to prevent the occurrence of the abnormal sound (the abnormal sound corresponds to an example of the problem due to the above transfer function error) which occurs when the microphone is covered, and to immediately decrease the noise when the covering of the microphone ends.

FIG. 1 shows an example of the change of the filter coefficient in case of using the active vibration noise control device in the comparative example. In FIG. 1, a horizontal axis shows the time, and a vertical axis shows the filter coefficient. According to the active vibration noise control device in the comparative example, when the constant abnormality occurs, there is a case that the continuous ups and downs of the filter coefficient between the first threshold and the second threshold occur. Therefore, there is a possibility that the cyclic abnormal sound is generated, and that the error signal detected by the microphone tends to increase (in other words, the vibration noise tends to increase). Thereby, the embodiment performs a process for suppressing the occurrence of the above problem according to the comparative example.

Figure 2:
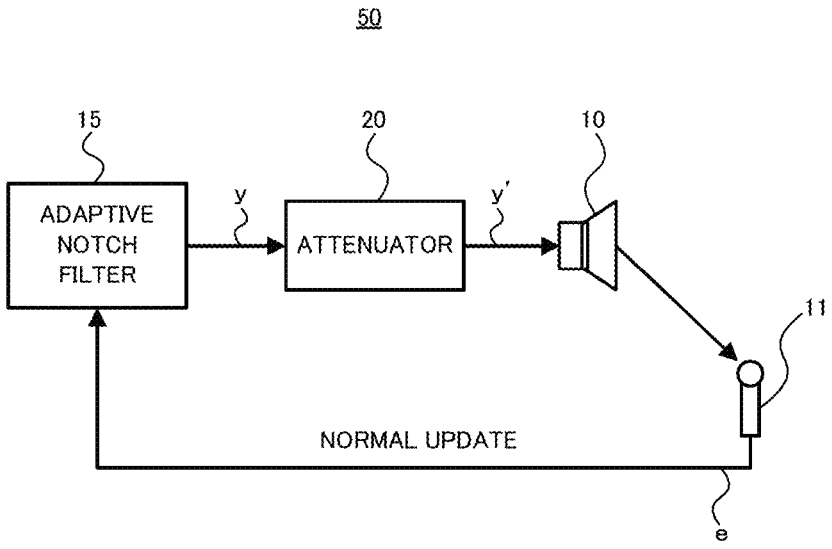
FIG. 2 shows a diagram for explaining a basic concept of a process performed by an active vibration noise control device in an embodiment.

Next, a description will be given of a basic concept of the process performed by an active vibration noise control device 50 in the embodiment, with reference to FIG. 2. FIG. 2 only shows main components of the active vibration noise control device 50 in the embodiment.

As shown in FIG. 2, according to the active vibration noise control device 50 in the embodiment, an attenuator 20 attenuates a control signal y generated by an adaptive notch filter 14 during the occurrence of the abnormality, and supplies the attenuated control signal y' to a speaker 10. Concretely, when the filter coefficient becomes larger, the active vibration noise control device 50 determines that the abnormality occurs (namely, the transfer function error occurs), and the attenuator 20 attenuates the control signal y generated by the adaptive notch filter 14 in order to significantly decrease the volume of the control sound from the speaker 10. For example, the control sound which is small enough to neglect it compared to the generated vibration noise is outputted from the speaker 10. Then, when the above control sound is outputted from the speaker 10, the adaptive notch filter 15 uses the filter coefficient which is normally updated based on the error signal "e" outputted from the microphone 11.

By decreasing the control sound of the speaker 10 during the occurrence of the abnormality, the change of the filter coefficient becomes smaller (namely, the update rate becomes slower), and the filter coefficient is maintained at a relatively large value. Therefore, by the embodiment, during the occurrence of the abnormality, it is possible to suppress the continuous ups and downs of the filter coefficient like the comparative example. Hence, by the embodiment, it becomes possible to suppress the occurrence of the cyclic abnormal sound and the increase in the vibration noise during the occurrence of the abnormality.

Additionally, the active vibration noise control device 50 in the embodiment sets a limit of an attenuating degree of the control signal y, and attenuates the control signal y in a range corresponding to the limit. Namely, the active vibration noise control device 50 prohibits such an attenuation that the control signal becomes smaller than the limit. In other words, the active vibration noise control device 50 restricts the control signal y so that the volume of the control sound does not become smaller than a predetermined amount. This is because, since the control sound from the speaker 10 provides a clue to distinguishing the normal from the abnormality, it is not possible to appropriately determine the normal and the abnormality if the volume of the control sound decreases too much. For example, there is a case that a recovery operation cannot be appropriately performed when the state is switched from the abnormality to the normal.

Device Configuration

Next, a description will be given of a concrete configuration of the active vibration noise control device 50 in the embodiment, with reference to FIG. 3.

At first, a description will be given of an outline of the process performed by the active vibration noise control device 50 in the embodiment. The active vibration noise control device calculates an amplitude (hereinafter referred to as "w-amplitude") of the filter coefficient, and determines that the abnormality occurs when the calculated w-amplitude is larger than a predetermined threshold. Namely, the active vibration noise control device 50 determines that the transfer function error occurs. In this case, the active vibration noise control device 50 performs the process for attenuating the control signal y generated by the adaptive notch filter 15. Here, the active vibration noise control device 50 uses a square root of a sum of squares of a real part and an imaginary part ("$w_0$" and "$w_1$" as described below) of the filter coefficient, as "w-amplitude". Additionally, the threshold for determining the w-amplitude is set based on a maximum value of the w-amplitude when the transfer function error does not occur (namely, during the normal behavior). Specifically, the threshold is at least larger than the maximum value of the w-amplitude (hereinafter referred to as "w-amplitude maximum value") during the normal behavior, and a difference between the threshold and the w-amplitude maximum value is equal to or smaller than a predetermined value.

Furthermore, the active vibration noise control device 50 sets a attenuation ratio indicating a ratio of the attenuated control signal y' to the control signal y generated by the adaptive notch filter 15, and attenuates the control signal y based on the set attenuation ratio. The attenuation ratio is smaller than "1". Hereinafter, the attenuation ratio is represented as "ATT". Concretely, when the w-amplitude is larger than the threshold, the active vibration noise control device 50 performs the process for decreasing the ATT so as to deal with the abnormality. In details, the active vibration noise control device 50 sets a lower limit of the ATT (hereinafter represented as "ATTmin"), and fixes the ATT to the ATTmin when the ATT becomes smaller than the ATTmin as a result of the decrease in the ATT. Namely, the active vibration noise control device 50 does not set the ATT to a value being smaller than the ATTmin. So, the ATT is set to a value in such a range as "ATTmin<=ATT<=1".

Additionally, when the w-amplitude decreases from a value being larger than the threshold to a value being equal to or smaller than the threshold, the active vibration noise control device 50 determines that the state is switched from the abnormality to the normal. Namely, the active vibration noise control device 50 determines that the transfer function error is removed. In this case, the active vibration noise control device 50 increases the ATT so as to perform the recovery operation. In details, when the ATT becomes larger than "1" as a result of the increase in the ATT, the active vibration noise control device 50 fixes the ATT to "1".

Figure 3:
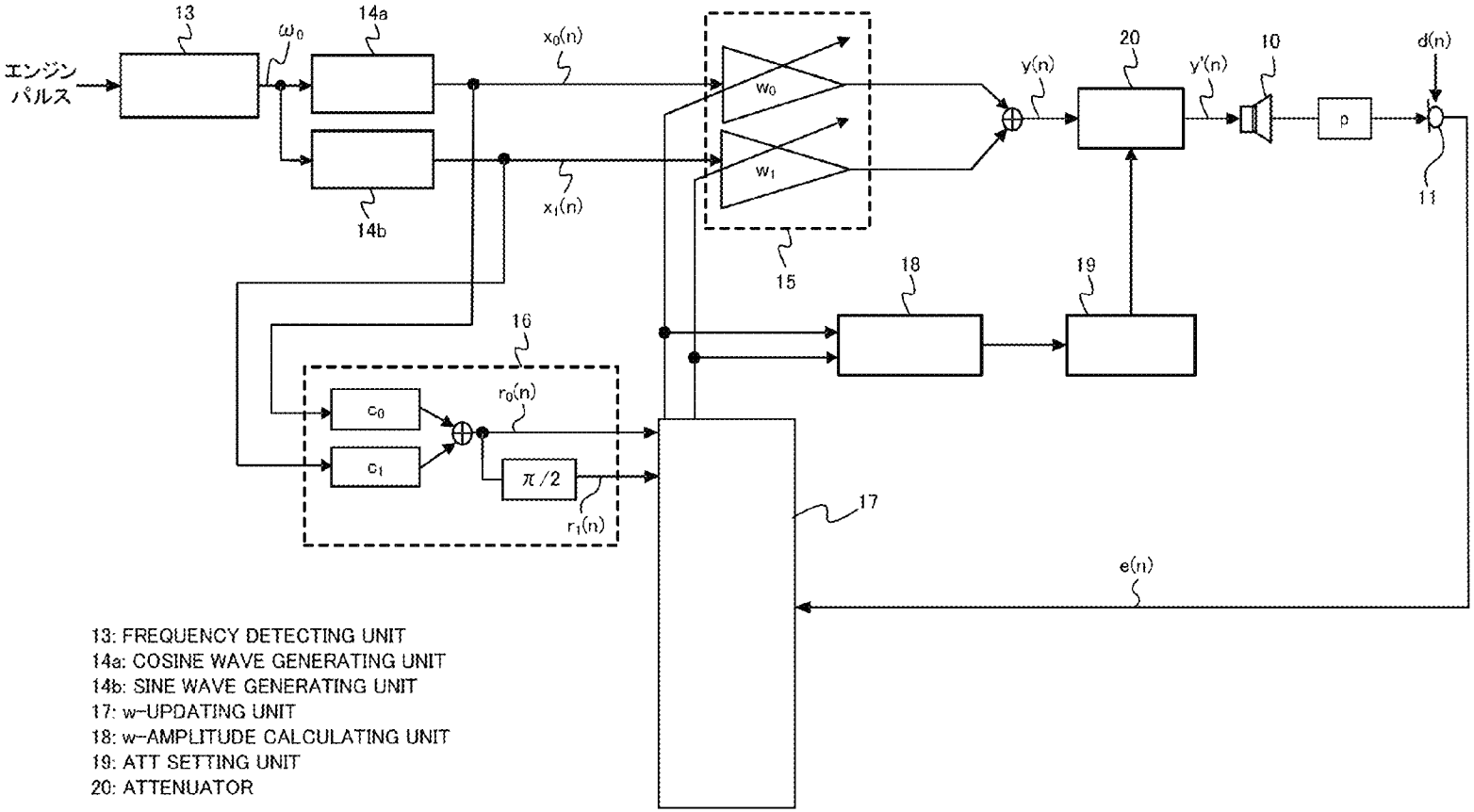
FIG. 3 is a block diagram showing a configuration of an active vibration noise control device in an embodiment.

FIG. 3 is a block diagram showing the configuration of the active vibration noise control device 50 in the embodiment. The active vibration noise control device 50 includes a speaker 10, a microphone 11, a frequency detecting unit 13, a cosine wave generating unit 14*a*, a sine wave generating unit 14*b*, an adaptive notch filter 15, a reference signal generating unit 16, a w-updating unit 17, a w-amplitude calculating unit 18, an ATT setting unit 19 and an attenuator 20.

The active vibration noise control device 50 is mounted on a vehicle. For example, the speaker 10 is installed on the right front door in the vehicle, and the microphone 11 is installed over the driver's head. Basically, the active vibration noise control device 50 uses the speaker 10 and the microphone 11, and generates the control sound from the speaker 10 based on a frequency in accordance with a revolution of an output axis of an engine, so as to actively control the vibration noise of the engine as the vibration noise source. Concretely, the active vibration noise control device 50 feeds back the error signal (hereinafter referred to as "error microphone signal"), and minimizes the error by using the adaptive notch filter 15, so as to actively control the vibration noise.

A concrete description will be given of the components of the active vibration noise control device 50. The frequency detecting unit 13 is supplied with the engine pulse and detects a frequency $\omega_0$ of the engine pulse. Then, the frequency detecting unit 13 supplies the cosine wave generating unit 14*a* and the sine wave generating unit 14*b* with a signal corresponding to the frequency $\omega_0$.

The cosine wave generating unit 14*a* and the sine wave generating unit 14*b* generate a basic cosine wave $x_0(n)$ and a basic sine wave $x_1(n)$ which include the frequency $\omega_0$ detected by the frequency detecting unit 13. Concretely, as shown by expressions (1) and (2), the cosine wave generating unit 14*a* and the sine wave generating unit 14*b* generate the basic cosine wave $x_0(n)$ and the basic sine wave $x_1(n)$. In the expressions (1) and (2), "n" is natural number and corresponds to time (The same will apply hereinafter). Additionally, "A" indicates amplitude, and "ϕ" indicates an initial phase.

$$x_0(n)=A\cos(\omega_0 n+\phi) \tag{1}$$

$$x_1(n)=A\sin(\omega_0 n+\phi) \tag{2}$$

Then, the cosine wave generating unit 14*a* and the sine wave generating unit 14*b* supply the adaptive notch filters 15 and the reference signal generating units 16 with basic signals corresponding to the basic cosine wave $x_0(n)$ and the basic sine wave $x_1(n)$. Thus, the cosine wave generating unit 14*a* and the sine wave generating unit 14*b* correspond to an example of "basic signal generating unit".

The adaptive notch filter 15 performs the filter process of the basic cosine wave $x_0(n)$ and the basic sine wave $x_1(n)$, so as to generate the control signal y(n) supplied to the speaker 10. In this case, the adaptive notch filter supplies the control signal y(n) to the attenuator 20. Concretely, the adaptive notch filter 15 generates the control signal y(n) based on the filter coefficients $w_0(n)$ and $w_1(n)$ inputted from the w-updating unit 17. Specifically, as shown by an expression (3), the adaptive notch filter 15 adds a value obtained by multiplying the basic cosine wave $x_0(n)$ by the filter coefficient $w_0(n)$, to a value by multiplying the basic sine wave $x_1(n)$ by the filter coefficient $w_1(n)$, so as to calculate the control signal y(n). The filter coefficient $w_0$ corresponds to the real part, and the filter coefficient $w_1$ corresponds to the imaginary part. Hereinafter, when the filter coefficients $w_0$ and $w_1$ are used with no distinction, the filter coefficients $w_0$ and $w_1$ are represented as "filter coefficient w".

$$y(n)=w_0(n)x_0(n)+w_1(n)x_1(n) \tag{3}$$

The w-amplitude calculating unit 18 calculates the w-amplitude based on the filter coefficients $w_0(n)$ and $w_1(n)$ supplied by the w-updating unit 17, and supplies the ATT setting unit 19 with a signal corresponding to the w-amplitude. Concretely, as shown by an expression (4), the w-amplitude calculating unit 18 calculates the square root of the sum of squares of the filter coefficients $w_0(n)$ and $w_1(n)$, as the w-amplitude. Thus, the w-amplitude calculating unit 18 corresponds to an example of "amplitude calculating unit".

$$w\text{-amplitude}=\sqrt{\{(w_0(n))^2+(w_1(n))^2\}} \tag{4}$$

The ATT setting unit 19 sets the ATT (attenuation ratio) for attenuating the control signal y(n) generated by the adaptive notch filter 15, based on the w-amplitude calculated by the w-amplitude calculating unit 18, and supplies the attenuator 20 with a signal corresponding to the ATT. Concretely, the ATT setting unit 19 sets the ATT based on a magnitude relation between the w-amplitude and the threshold. In this case, the threshold is preliminarily determined by an experiment and/or a simulation, and is stored in a storage unit (which is not shown). The ATT setting unit 19 reads out the threshold stored in the storage unit, and performs the process.

In details, when the w-amplitude is larger than the threshold, the ATT setting unit 19 decreases the ATT. In this case, the ATT setting unit 19 determines a value which is obtained by multiplying the ATT set last time by a predetermined value being smaller than "1", as the ATT which should be used this time. Then, when the ATT becomes smaller than the ATTmin as a result of the decrease in the ATT, the ATT setting unit 19 sets the ATT to the ATTmin. Namely, the ATT setting unit 19 does not set the ATT to a value being smaller than the ATTmin.

Meanwhile, when the w-amplitude is equal to or smaller than the threshold, the ATT setting unit 19 increases the ATT. In this case, the ATT setting unit 19 determines a value which is obtained by multiplying the ATT set last time by a predetermined value being larger than "1", as the ATT which should be used this time. Then, when the ATT becomes larger than "1" as a result of the increase in the ATT, the ATT setting unit 19 sets the ATT to "1". Thus, the ATT setting unit 19 corresponds to an example of "attenuation ratio setting unit".

The attenuator 20 attenuates the control signal y(n) generated by the adaptive notch filter 15 based on the ATT set by the ATT setting unit 19, and supplied the speaker 10 with the attenuated control signal y'(n). Concretely, as shown by an expression (5), the attenuator 20 supplies a value which is obtained by multiplying the control signal (n) by the ATT, as the control signal y'(n).

$$y'(n)=y(n)\times \mathrm{ATT} \tag{5}$$

As shown by the expression (5), when the ATT is smaller than "1", the control signal y(n) is attenuated. In this case, the control signal y' (n) which is obtained by attenuating the control signal y(n) generated by the adaptive notch filer 15 is supplied to the speaker 10. Meanwhile, when the ATT is "1", the control signal y(n) is not attenuated. In this case, the control signal y(n) generated by the adaptive notch filer 15 is directly supplied to the speaker 10, as the control signal y'(n). Thus, the ATT setting unit 19 and the attenuator 20 correspond to an example of "attenuating unit".

The speaker 10 generates the control sound corresponding to the control signal y'(n) supplied by the attenuator 20. The control sound generated by the speaker 10 is transferred to the microphone 11. A transfer function from the speaker 10 to the microphone 11 is represented by "p". The transfer function p is defined by frequency $\omega_0$, and depends on the sound field characteristic and the distance from the speaker 10 to the microphone 11. The transfer function p from the speaker 10 to the microphone 11 is preliminary set by a measurement.

The microphone 11 detects the cancellation error between the vibration noise of the engine and the control sound generated by the speaker 10, and supplies the w-updating unit 17 with the cancellation error as the error signal e(n). Concretely, the microphone 11 outputs the error signal e(n) in accordance with the control signal y' (n), the transfer function p and the vibration noise d(n) of the engine.

The reference signal generating unit 16 generates the reference signal from the basic cosine wave $x_0(n)$ and the basic sine wave $x_1(n)$ based on the above transfer function p, and supplies the w-updating unit 17 with the reference signal. Concretely, the reference signal generating unit 16 uses a real part $c_0$ and an imaginary part $c_1$ of the transfer function p. Specifically, the reference signal generating unit 16 adds a value obtained by multiplying the basic cosine wave $x_0(n)$ by the real part $c_0$ of the transfer function p, to a value obtained by multiplying the basic sine wave $x_1(n)$ by the imaginary part $c_1$ of the transfer function p, and outputs a value obtained by the addition as the reference signal $r_0(n)$. In addition, the reference signal generating unit 16 delays the reference signal $r_0(n)$ by "$\pi/2$", and outputs the delayed signal as the reference signal $r_1(n)$. Thus, the reference signal generating unit 16 corresponds to "reference signal generating unit".

The w-updating unit 17 updates the filter coefficient used by the adaptive notch filter 15 based on the LMS (Least Mean Square) algorism, and supplies the adaptive notch filter 15 with the updated filter coefficient. Concretely, the w-updating unit 17 updates the filter coefficient used by the adaptive notch filter 15 last time so as to minimize the error signal e(n), based on the error signal e(n) and the reference signals $r_0(n)$, $r_1(n)$. The filter coefficient after the update is represented by "$w_0(n+1)$" and "$w_1(n+1)$", and the filter coefficient before the update is represented by "$w_0(n)$" and "$w_1(n)$". As shown by expressions (6) and (7), the filter coefficients after the update $w_0(n+1)$ and $w_1(n+1)$ are calculated. Thus, the w-updating unit 17 corresponds to an example of "filter coefficient updating unit".

$$w_0(n+1)=w_0(n)-\mu\cdot e(n)\cdot r_0(n) \tag{6}$$

$$w_1(n+1)=w_1(n)-\mu\cdot e(n)\cdot r_1(n) \tag{7}$$

In the expressions (6) and (7), "μ" is a coefficient called a step-size parameter for determining a convergence speed. In other words, "μ" is a coefficient related to an update rate of the filter coefficient. For example, a preliminarily set value is used as the step-size parameter μ.

ATT Setting Process

Figure 4:
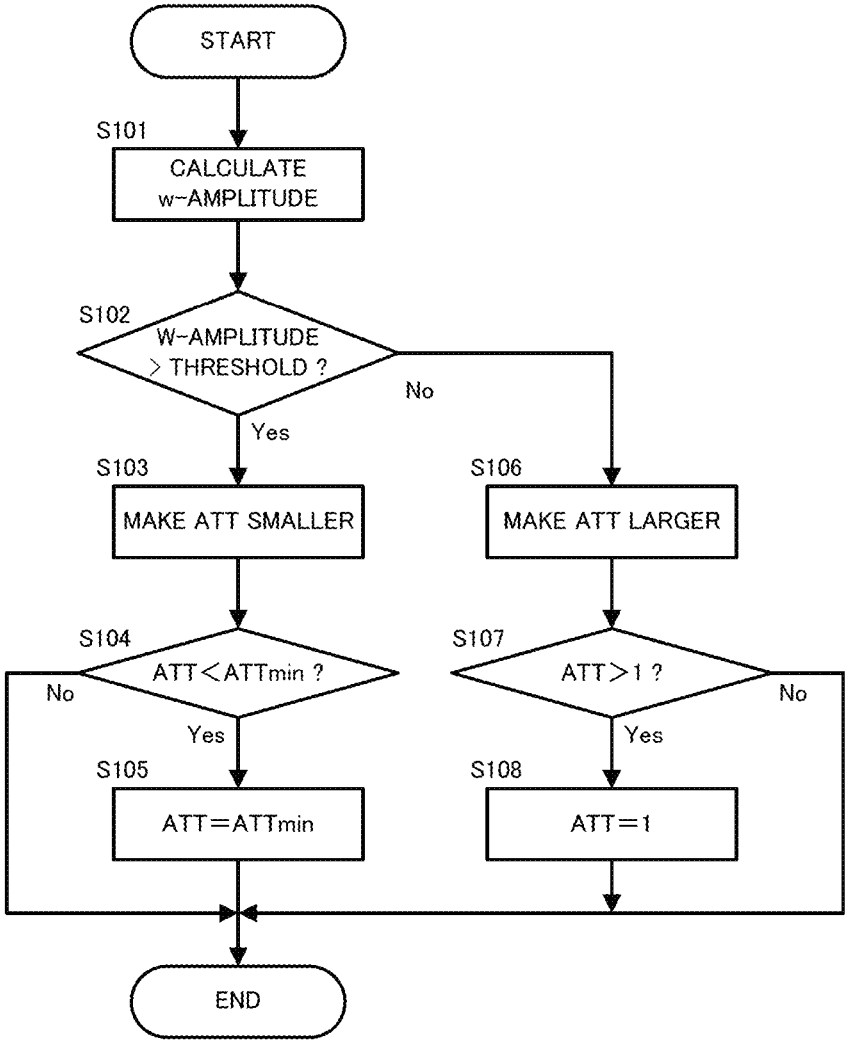
FIG. 4 is a flow chart showing an ATT setting process.

Next, a description will be given of an ATT setting process in the embodiment, with reference to FIG. 4. FIG. 4 is a flow chart showing the ATT setting process. The process is repeatedly executed by the w-amplitude calculating unit 18 and the ATT setting unit 19 in a predetermined cycle.

First, in step S101, the w-amplitude calculating unit 18 calculates the w-amplitude based on the filter coefficient w supplied by the w-updating unit 17. Concretely, as shown by the expression (4), the w-amplitude calculating unit 18 calculates the square root of the sum of squares of the real part $w_0$ and the imaginary part $w_1$ of the filter coefficient w, as the w-amplitude. Then, the w-amplitude calculating unit 18 supplies the ATT setting unit 19 with the signal corresponding to the calculated w-amplitude. Afterward, the process goes to step S102.

In step S102, the ATT setting unit 19 determines whether or not the w-amplitude supplied by the w-amplitude calculating unit 18 is larger than the threshold. The ATT setting unit 19 determines whether or not the abnormality occurs (namely, the transfer function error occurs), based on the relationship between the w-amplitude and the threshold. In this case, the threshold is at least larger than the w-amplitude maximum value, and the difference between the threshold and the w-amplitude maximum value is equal to or smaller than the predetermined value. For example, in consideration of the above standpoint, the threshold is determined by preliminarily performing an experiment and/or a simulation in the vehicle on which the active vibration noise control device 50 is mounted. The determined threshold is stored in the storage unit such as a memory. The ATT setting unit 19 reads out the threshold stored in the storage unit, and performs the determination in step S102.

When the w-amplitude is larger than the threshold (step S102: Yes), the process goes to step S103. In this case, it is thought that the abnormality occurs (namely, the transfer function error occurs). Therefore, in steps S103 to S105, the ATT is set in order to deal with the abnormality.

In step S103, the ATT setting unit 19 performs the process for making the ATT smaller. Concretely, the ATT setting unit 19 determines the value which is obtained by multiplying the ATT set last time by the predetermined value being smaller than "1", as the ATT which should be used this time. Then, the process goes to step S104. Here, a preliminarily set value is used as the predetermined value for making the ATT smaller. A constant (fixed value) may be used as the predetermined value, or a variable which is varied in accordance with the difference between the w-amplitude and the threshold may be used as the predetermined value, for example.

In step S104, the ATT setting unit 19 determines whether or not the ATT calculated in step S103 is smaller than the ATTmin. When the ATT is smaller than the ATTmin (step S104: Yes), the process goes to step S105. In this case, the ATT setting unit 19 sets the ATT to the ATTmin in order to prevent the ATT from being smaller than the ATTmin (step S105). Then, the process ends. In contrast, when the ATT is equal to or larger than the ATTmin (step S104: No), the process ends. In this case, the ATT setting unit 19 sets the ATT calculated in step S103.

Meanwhile, when the w-amplitude is equal to or smaller that the threshold (step S102: Yes), the process goes to step S106. In this case, it is thought that the abnormality does not occur (namely, the transfer function error scarcely occurs). Therefore, in steps S106 to S108, the ATT is set in order to perform the normal operation, or in order to perform the recovery operation from the abnormality to the normal.

In step S106, the ATT setting unit 19 performs the process for making the ATT larger. Concretely, the ATT setting unit 19 determines the value which is obtained by multiplying the ATT set last time by the predetermined value being larger than "1", as the ATT which should be used this time. Then, the process goes to step S107. Here, a preliminarily set value is used as the predetermined value for making the ATT larger. A constant (fixed value) may be used as the predetermined value, or a variable which is varied in accordance with the difference between the w-amplitude and the threshold may be used as the predetermined value, for example.

In step S107, the ATT setting unit determines whether or not the ATT calculated in step S106 is larger than "1". When the ATT is larger than "1" (step S107: Yes), the process goes to step S108. In this case, the ATT setting unit 18 set the ATT to "1" (step S108). Then, the process ends. In contrast, when the ATT is equal to or smaller than "1" (step S107: No), the process ends. In this case, the ATT setting unit 19 sets the ATT calculated in step S106.

After the above flow, the attenuator 20 attenuates the control signal y(n) generated by the adaptive notch filter 15, by using the above ATT set by the ATT setting unit 19. Then, the attenuator 20 supplied the speaker 10 with the attenuated control signal y'(n).

Effect of Embodiment

Next, a description will be given of an effect of the embodiment, with reference to FIGS. 5A and 5B and FIGS. 6A and 6B. Here, the effect of the embodiment is compared with an effect of the above comparative example.

Figure 5A:
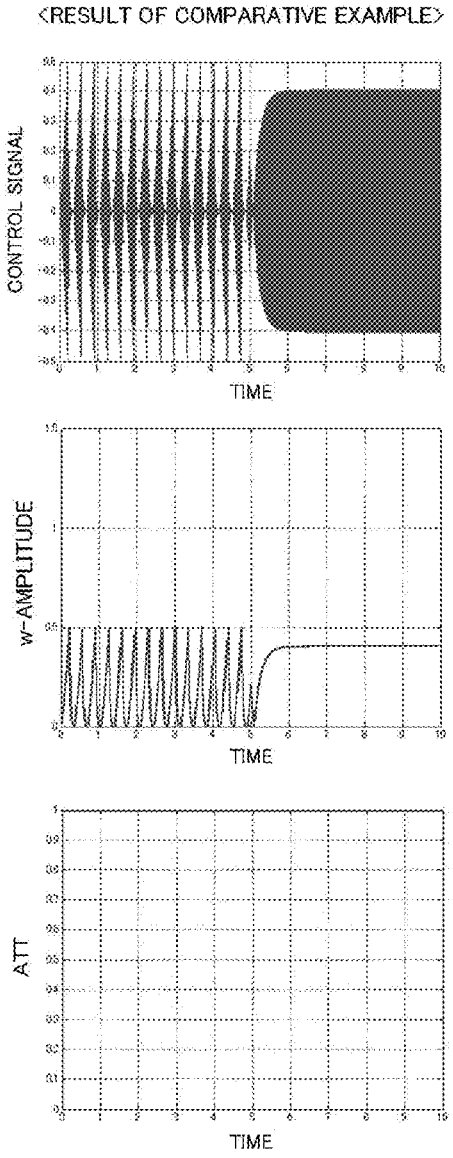
FIGS. 5A and 5B show result examples of an embodiment and a comparative example.
Figure 5B:
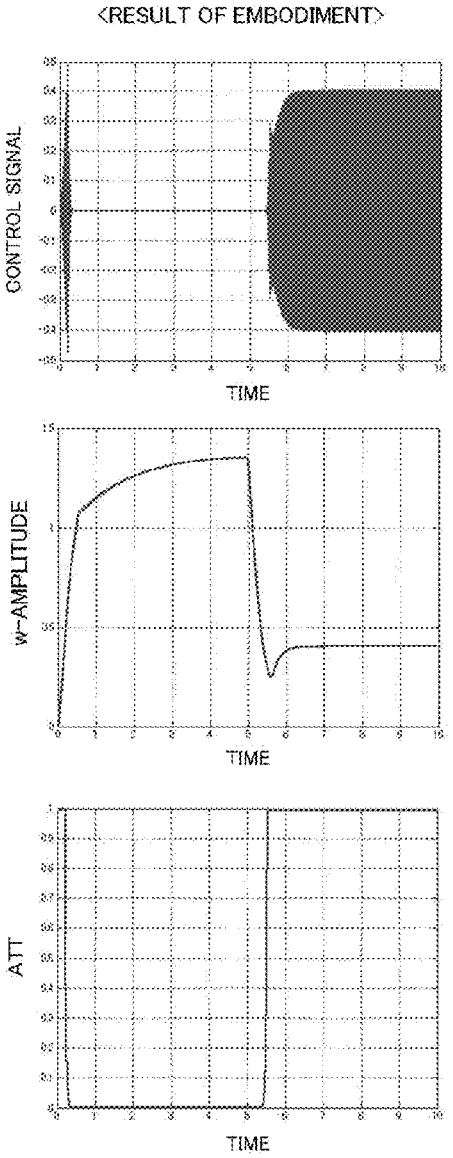

FIGS. 5A and 5B show result examples of the embodiment and the comparative example. Here, as for both the embodiment and the comparative example, it is assumed that the results are obtained when the active vibration noise control device is mounted on the vehicle, and the speaker is installed on the right front door, and the microphone is installed over the driver's head. Additionally, as for both the embodiment and the comparative example, it is assumed that the results are obtained when the vibration noise (engine noise) of 100 [Hz] is generated for 10 seconds, and the phase error of the transfer function is set to 180 degrees in first 5 seconds, and the phase error of the transfer function is set to 0 degree in latter 5 seconds (namely, the transfer function error is removed). In other words, the abnormality occurs in the first 5 seconds, and the abnormality doe not occur in the latter 5 seconds. Furthermore, as for the embodiment, it is assumed that the threshold is set to "0.5", and that the ATTmin is set to "0.001 (=−60 [dB])". Meanwhile, as for the comparative example, it is assumed that the first threshold is set to "0.5", and that the second threshold is set to "0.001 (=−60[dB])".

FIG. 5A shows a result example of the comparative example, and FIG. 5B shows a result example of the embodiment. Concretely, in FIGS. 5A and 5B, a time change of the control signal, a time change of the w-amplitude and a time change of the ATT, in descending order. Since the comparative example does not use the ATT, a graph in which the ATT is fixed to "1" is shown.

As shown in FIG. 5A, according to the comparative example, during the first 5 seconds in which the transfer function error occurs, it can be understood that the continuous ups and downs of the w-amplitude between the first threshold and the second threshold occur, and that the control signal significantly changes. Additionally, according to the comparative example, after the phase error of the transfer function is switched from 180 degrees to 0 degree (namely, after 5 seconds elapse), it can be understood that the w-amplitude becomes such a value that the w-amplitude can be set during the normal. Namely, it can be understood that the normal recovery is performed.

Meanwhile, as shown in FIG. 5B, according to the embodiment, during the first 5 seconds in which the transfer function error occurs, it can be understood that the continuous ups and downs of the w-amplitude like the comparative example does not occur. Concretely, according to the embodiment, it can be understood that the w-amplitude is maintained at a relatively large value. Additionally, according to the embodiment, during the first 5 seconds in which the transfer function error occurs, it can be understood that the control signal becomes a significantly small value. Concretely, it can be understood that the control sound which is small enough to neglect it compared to the vibration noise is outputted. This is caused by the attenuating process in the attenuator 20 by using the ATT. In addition, according to the embodiment, after the phase error of the transfer function is switched from 180 degrees to 0 degree (namely, after 5 seconds elapse), it can be understood that the w-amplitude becomes such a value that the w-amplitude can be set during the normal (concretely, a value being smaller than "0.5" of the threshold). Namely, it can be understood that the normal recovery is performed.

Figure 6B:
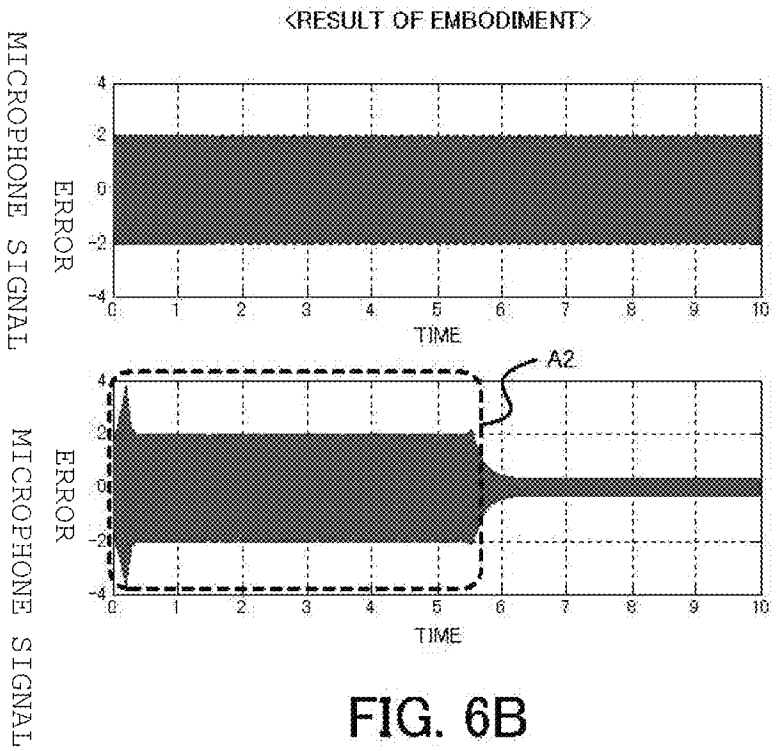
FIGS. 6A and 6B show examples of error microphone signals by an embodiment and a comparative example.
Figure 6A:
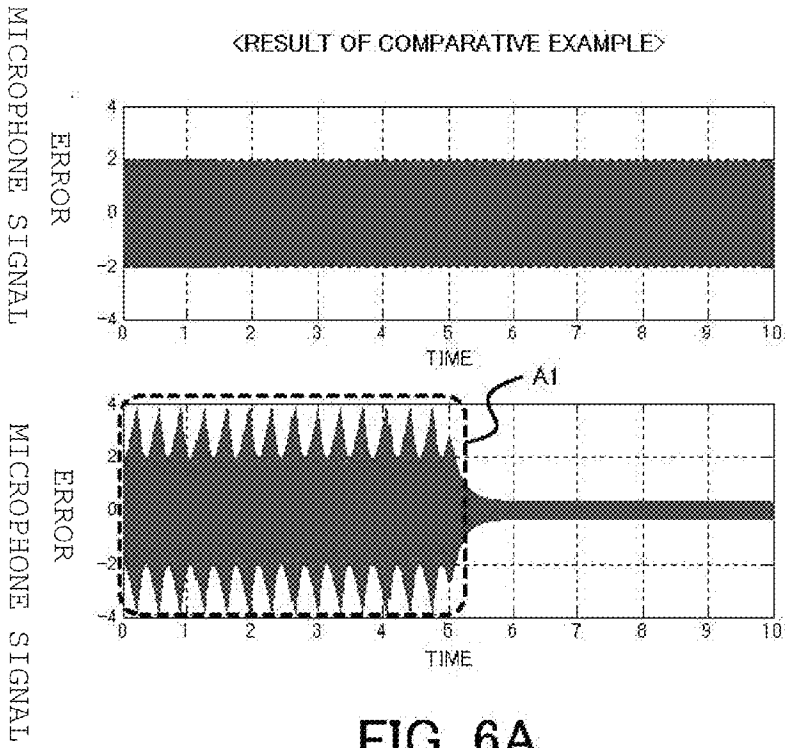

Next, FIGS. 6A and 6B show examples of the error microphone signals by the embodiment and the comparative example. The error microphone signals are obtained when the same condition as FIGS. 5A and 5B is set. Namely, FIGS. 6A and 6B show the examples of the error microphone signals which are obtained when the control signal, the w-amplitude and the ATT as shown in FIGS. 5A and 5B are used.

FIG. 6A shows an example of the error microphone signal by the comparative example, and FIG. 6B shows an example of the error microphone signal by the embodiment. In FIGS. 6A and 6B, upper graphs show time changes of the error microphone signal (corresponding to the vibration noise itself) when the control for decreasing the vibration noise is not performed, and lower graphs show time changes of the error microphone signal by the comparative example and the embodiment. Namely, the lower graphs in FIGS. 6A and 6B show an example of the error microphone signal in case of using the active vibration noise control device according to the comparative example, and an example of the error microphone signal in case of using the active vibration noise control device 50 according to the embodiment.

As shown by an area A1 in FIG. 6A drawn by a broken line, according to the comparative example, during the first 5 seconds in which the transfer function error occurs, it can be understood that the error microphone signal exceeding the vibration noise cyclically occurs. Namely, according to the comparative example, it can be understood that the cyclic abnormal sound and the increase in the vibration noise occur. Afterward, according to the comparative example, since the normal recovery is performed after the phase error of the transfer function is switched from 180 degrees to 0 degree, it can be understood that the error microphone signal becomes smaller.

Meanwhile, as shown by an area A2 in FIG. 6B drawn by a broken line, according to the embodiment, during the first 5 seconds in which the transfer function error occurs, it can be understood that, though the error microphone signal exceeds the vibration noise in only a short time, the error microphone signal becomes roughly the same as the vibration noise after that time. Namely, according to the embodiment, it can be understood that the cyclic abnormal sound and the increase in the vibration noise like the comparative example do not occur. Afterward, according to the embodiment, since the normal recovery is performed after the phase error of the transfer function is switched from 180 degrees to 0 degree, it can be understood that the error microphone signal becomes smaller.

According to the above result, by the embodiment, it can be understood that the occurrence of the cyclic abnormal sound and the increase in the vibration noise during the abnormality can be appropriately suppressed. Additionally, by the embodiment, it can be understood that the recovery can be appropriately performed at the time of switching from the abnormality to the normal.

Comparative Result of Difference in Threshold

Next, a description will be given of a comparative result regarding the difference in the threshold used for determining the w-amplitude, with reference to FIGS. 7A to 7C.

Figures 7A, 7B, 7C:
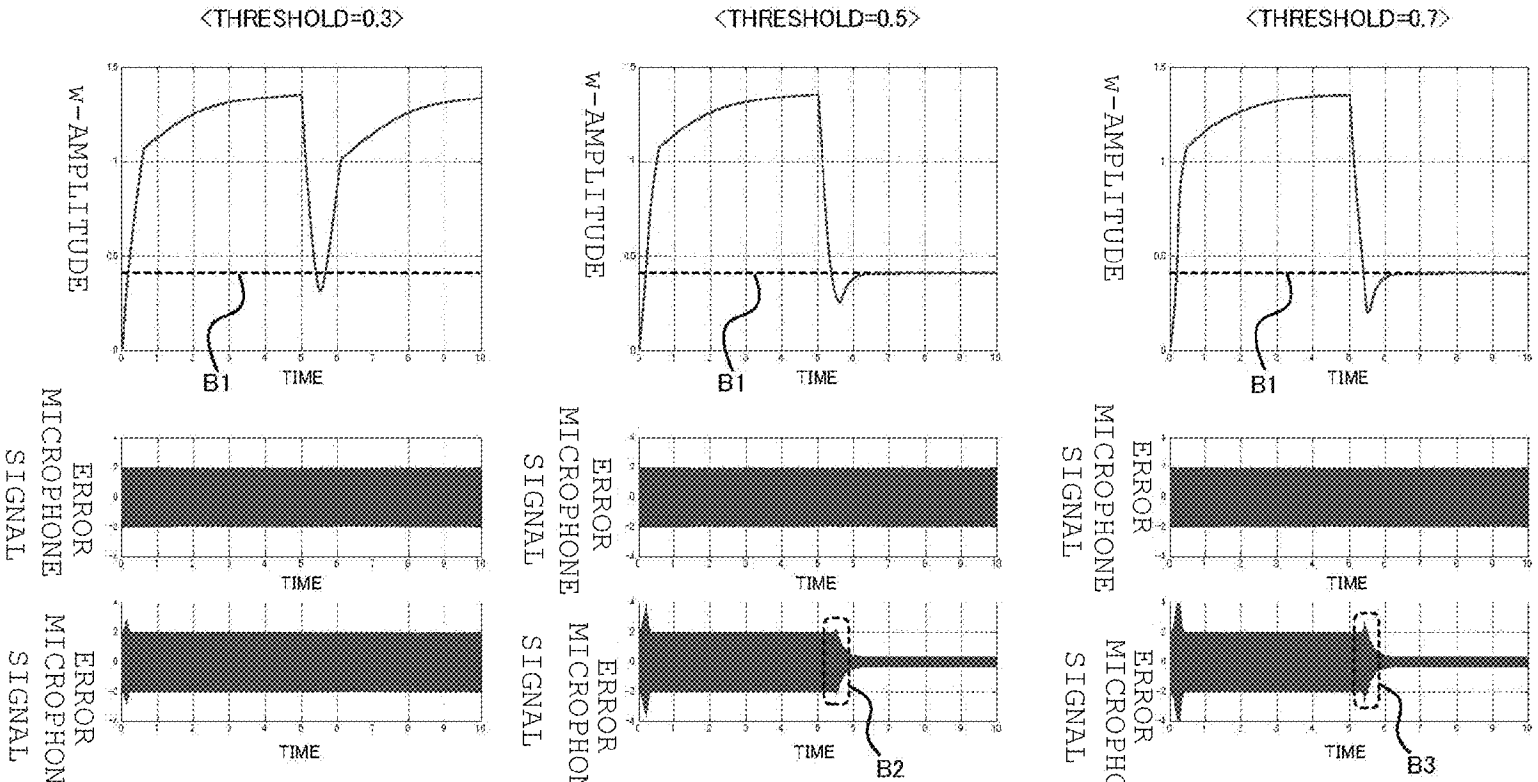
FIGS. 7A to 7C show comparative result examples in case of variously changing a threshold used for determining a w-amplitude.

FIGS. 7A to 7C show comparative result examples in case of variously changing the threshold used in the determination of the w-amplitude, by using the active vibration noise control device 50 in the embodiment.

Here, it is assumed that the results are obtained when the active vibration noise control device 50 in the embodiment is mounted on the vehicle, and the speaker is installed on the right front door, and the microphone is installed over the driver's head. Additionally, it is assumed that the results are obtained when the vibration noise (engine noise) of 100 [Hz] is generated for 10 seconds, and the phase error of the transfer function is set to 180 degrees in first 5 seconds, and the phase error of the transfer function is set to 0 degree in latter 5 seconds (namely, the transfer function error is removed). In other words, the abnormality occurs in the first 5 seconds, and the abnormality does not occur in the latter 5 seconds. Furthermore, it is assumed that the ATTmin is set to "0.001 (=−60 [dB])". Here, such an example that the maximum value of the w-amplitude (w-amplitude maximum value) during the normal is about "0.4" is shown (see broken lines B1 in FIGS. 7A to 7C).

FIG. 7A shows a result example in case of setting the threshold to "0.3", and FIG. 7B shows a result example in case of setting the threshold to "0.5", and FIG. 7C shows a result example in case of setting the threshold to "0.7". In FIGS. 7A to 7C, a time change of the w-amplitude, a time change of the error microphone signal (corresponding to the vibration noise itself) when the control for decreasing the vibration noise is not performed and a time change of the error microphone signal when the active vibration noise control device 50 in the embodiment is used, in descending order.

As shown in FIG. 7A, when the threshold is set to "0.3", after the phase error of the transfer function is switched from 180 degrees to 0 degree, it can be understood that the w-amplitude does not become such a value that the w-amplitude can be set during the normal. Concretely, it can be understood that the w-amplitude increases to a relatively large value. Additionally, after the phase error is switched from 180 degrees to 0 degree, it can be understood that the error microphone signal is maintained at a relatively large value, too. Thus, when the threshold is set to "0.3", it can be understood that the recovery operation is not performed. This is because, since the threshold (0.3) being smaller than the w-amplitude maximum value (about 0.4) is used, the active vibration noise control device 50 makes such a wrong determination that the abnormality occurs during the normal.

Meanwhile, as shown in FIG. 7B, when the threshold is set to "0.5", after the phase error of the transfer function is switched from 180 degrees to 0 degree, it can be understood that the w-amplitude becomes such a value that the w-amplitude can be set during the normal. Additionally, after the phase error is switched from 180 degrees to 0 degree, it can be understood that the error microphone signal becomes smaller. Thus, when the threshold is set to "0.5", it can be understood that the normal recovery is performed. This is because the threshold (0.5) being larger than the w-amplitude maximum value (about 0.4) is used. As shown by an area B2 drawn by a broken line, when the threshold is set to "0.5", it can be understood that the error microphone signal slightly increases at the time of performing the normal recovery.

As shown in FIG. 7C, when the threshold is set to "0.7", similar to the case of setting the threshold to "0.5", it can be understood that the normal recovery is performed after the phase error of the transfer function is switched from 180 degrees to 0 degree. This is because the threshold (0.7) being larger than the w-amplitude maximum value (about 0.4) is used. As shown by an area B3 drawn by a broken line, it can be understood that the error microphone signal slightly increases at the time of performing the normal recovery. In details, when the threshold is set to "0.7", amount of the increase in the error microphone signal at the time of performing the recovery is larger than when the threshold is set to "0.5".

According to the above result, it is preferable to set the threshold to a value being at least larger than the w-amplitude maximum value in order to appropriately determine the normal and the abnormality (concretely, in order to prevent such a wrong determination that the abnormality occurs during the normal). Additionally, it is preferable to set the threshold to a value which is as close to the w-amplitude maximum value as possible, in order to appropriately suppress the increase in the error microphone signal at the time of performing the recovery. For example, by an experiment and/or a simulation, an acceptable difference between the threshold and the w-amplitude maximum value is preliminarily calculated based on the amount of the increase in the error microphone signal at the time of performing the recovery, and the said difference is set to the predetermined value, and such a value that the difference from the w-amplitude maximum value is equal to or smaller than the said predetermined value can be determined as the threshold.

Comparative Result of Difference in ATTmin

Next, a description will be given of a comparative result regarding the difference in the ATTmin used for setting the ATT, with reference to FIGS. 8A to 8C.

Figures 8A, 8B, 8C:
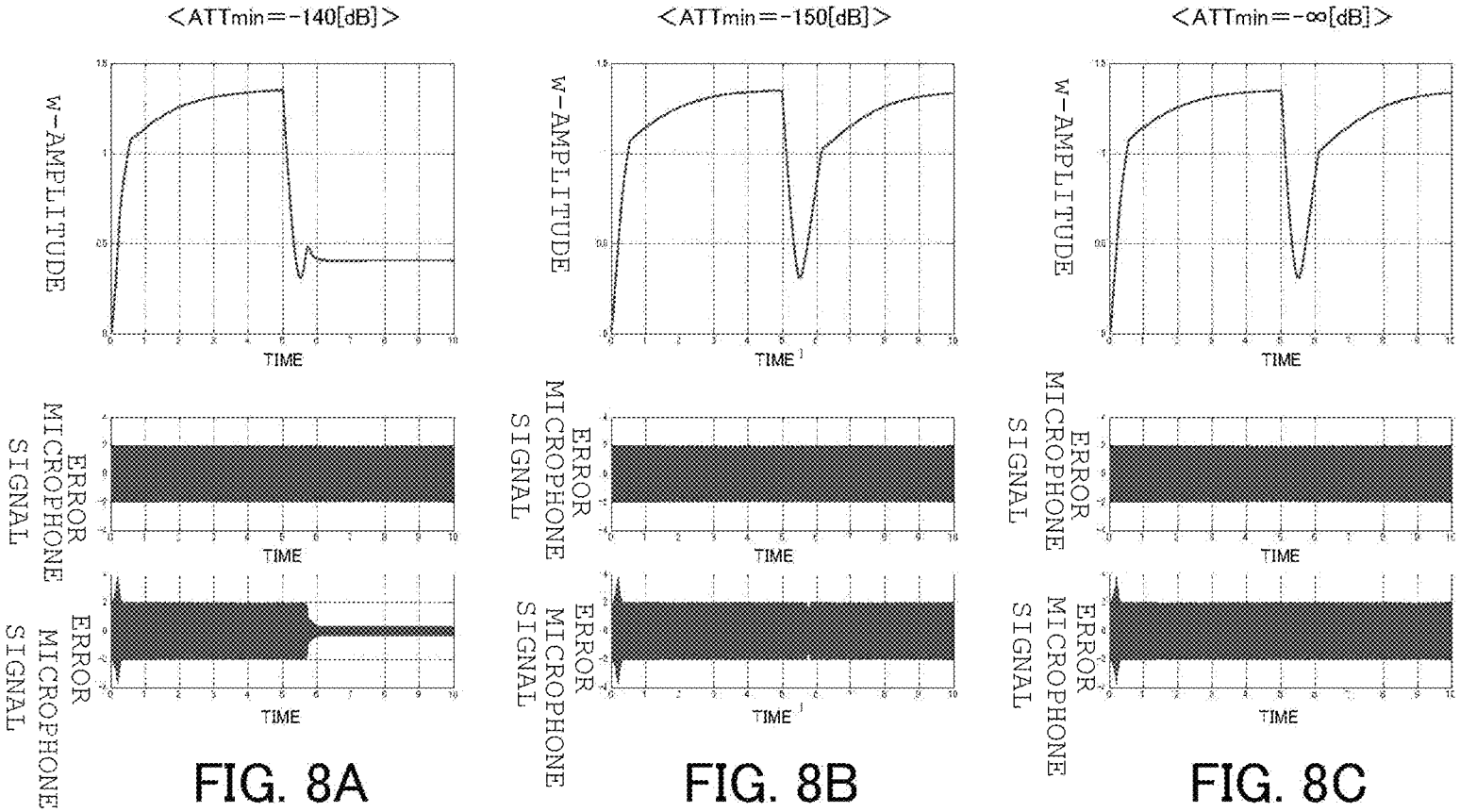
FIGS. 8A to 8C show comparative result examples in case of variously changing an ATTmin.

FIGS. 8A to 8C show comparative result examples in case of variously changing the ATTmin, by using the active vibration noise control device 50 in the embodiment.

Here, it is assumed that the results are obtained when the active vibration noise control device 50 in the embodiment is mounted on the vehicle, and the speaker is installed on the right front door, and the microphone is installed over the driver's head. Additionally, it is assumed that the results are obtained when the vibration noise (engine noise) of 100 [Hz] is generated for 10 seconds, and the phase error of the transfer function is set to 180 degrees in first 5 seconds, and the phase error of the transfer function is set to 0 degree in latter 5 seconds (namely, the transfer function error is removed). In other words, the abnormality occurs in the first 5 seconds, and the abnormality does not occur in the latter 5 seconds. Furthermore, it is assumed that the threshold is set to "0.5".

FIG. 8A shows a result example in case of setting the ATTmin to "−140 [dB]", and FIG. 8B shows a result example in case of setting the ATTmin to "−150 [dB]", and FIG. 8C shows a result example in case of setting the ATTmin to "−∞ [dB]". In FIGS. 8A to 8C, a time change of the w-amplitude, a time change of the error microphone signal (corresponding to the vibration noise itself) when the control for decreasing the vibration noise is not performed, and a time change of the error microphone signal when the active vibration noise control device 50 in the embodiment is used, in descending order.

As shown in FIG. 8A, when the ATTmin is set to "−140 [dB]", after the phase error of the transfer function is switched from 180 degrees to 0 degree, it can be understood that the w-amplitude becomes such a value that the w-amplitude can be set during the normal. Additionally, after the phase error is switched from 180 degrees to 0 degree, it can be understood that the error microphone signal becomes smaller. Thus, when the ATTmin is set to "−140 [dB]", it can be understood that the normal recovery is performed.

Meanwhile, as shown in FIGS. 8B and 8C, when the ATTmin is set to "−150 [dB]" and "−∞ [dB]", after the phase error of the transfer function is switched from 180 degrees to 0 degree, it can be understood that the w-amplitude does not become such a value that the w-amplitude can be set during the normal. Concretely, it can be understood that the w-amplitude increases to a relatively large value. Additionally, after the phase error is switched from 180 degrees to 0 degree, it can be understood that the error microphone signal is maintained at a relatively large value, too. Thus, when the ATTmin is set to "−150 [dB]" and "−∞ [dB]", it can be understood that the recovery operation is not performed. This is because, since the volume of the control sound is too small, the clue to distinguishing the normal from the abnormality is not provided.

According to the above result, it can be said that "−140 [dB]" is a lower limit of the ATTmin for performing the recovery operation. However, "−140 [dB]" is only one example. It can be said that the lower limit of the ATTmin for performing the recovery operation is changed due to a condition in which the active vibration noise control device 50 is used and/or various parameters used in the active vibration noise control device 50. Therefore, it is preferable to determine the ATTmin by preliminarily performing an experiment and/or a simulation in the vehicle on which the active vibration noise control device 50 is mounted.

Modification

The present invention is not limited to the above-described embodiment, and various changes may be made within the essence of the invention.

The above embodiment shows such an example that the square root of the sum of squares of the filter coefficients $w_0$ and $w_1$ is used as the w-amplitude (see the expression (4)). As another example, the sum of squares of the filter coefficients $w_0$ and $w_1$ may be used as the w-amplitude.

As another example, the threshold for determining the w-amplitude can be changed in accordance with the vibration noise frequency. This is because the maximum value of the w-amplitude (w-amplitude maximum value) during the normal tends to change due to the frequency band of the vibration noise. For example, a table which is associated with the threshold for each frequency band of the vibration noise can be preliminarily prepared, and the threshold can be changed in accordance with the frequency band by using the said table.

It is not limited that the present invention is applied to the active vibration noise control device 50 having only one speaker 10. The present invention can be applied to the active vibration noise control device having plural speakers. In this case, for each of the plural speakers, the control signal generated by the adaptive notch filter can be attenuated by the same method as the above embodiment, when the w-amplitude becomes larger than the threshold. Namely, as for such a speaker that the transfer function error occurs, the process for making the control sound smaller can be performed.

It is not limited that the present invention is applied to the active vibration noise control device 50 having only one microphone 11. The present invention can be applied to the active vibration noise control device having plural microphones.

It is not limited that the present invention is applied to the vehicle. Other than the vehicle, the present invention can be applied to various kinds of transportation such as a ship or a helicopter or an airplane.

INDUSTRIAL APPLICABILITY

This invention is applied to closed spaces such as an interior of transportation having a vibration noise source (for example, engine), and can be used for actively controlling a vibration noise.

DESCRIPTION OF REFERENCE NUMBERS

10 Speaker
11 Microphone
13 Frequency Detecting Unit
14*a* Cosine Wave Generating Unit
14*b* Sine Wave Generating Unit
15 Adaptive Notch Filter
16 Reference Signal Generating Unit
17 w-Updating Unit
18 w-amplitude Calculating Unit
19 ATT Setting Unit
20 Attenuator
50 Active Vibration Noise Control Device

The invention claimed is:

1. An active vibration noise control device for canceling a vibration noise by making a speaker output a control sound, comprising:

a basic signal generating unit which generates a basic signal based on a vibration noise frequency generated by a vibration noise source;

an adaptive notch filter which generates a control signal provided to the speaker by applying a filter coefficient to the basic signal, in order to make the speaker generate the control sound so that the vibration noise generated by the vibration noise source is canceled;

a microphone which detects a cancellation error between the vibration noise and the control sound, and outputs an error signal;

a reference signal generating unit which generates a reference signal from the basic signal based on a transfer function from the speaker to the microphone;

a filter coefficient updating unit which updates the filter coefficient used by the adaptive notch filter based on the error signal and the reference signal so as to minimize the error signal;

an amplitude calculating unit which calculates an amplitude of the filter coefficient updated by the filter coefficient updating unit; and an attenuating unit which attenuates the control signal generated by the adaptive notch filter, and provides the attenuated control signal to the speaker, when the amplitude calculated by the amplitude calculating unit is larger than a threshold.

2. The active vibration noise control device according to claim 1, wherein the attenuating unit sets a limit of an attenuating degree of the control signal, and attenuates the control signal in a range corresponding to the limit.

3. The active vibration noise control device according to claim 2, wherein the attenuating unit includes a attenuation ratio setting unit which sets an attenuation ratio indicating a ratio of the attenuated control signal to the control signal generated by the adaptive notch filter, and the attenuating unit attenuates the control signal based on the attenuation ratio set by the attenuation ratio setting unit, wherein the attenuation ratio setting unit decreases the attenuation ratio when the amplitude is larger than the threshold, and wherein the attenuation ratio setting unit uses a lower limit of the attenuation ratio corresponding to the limit of the attenuating degree of the control signal, and sets the attenuation ratio to the lower limit when the attenuation ratio becomes smaller than the lower limit.

4. The active vibration noise control device according to claim 3, wherein the attenuation ratio setting unit increases the attenuation ratio when the amplitude becomes equal to or smaller than the threshold, and sets the attenuation ratio to "1" when the attenuation ratio becomes larger than "1".

5. The active vibration noise control device according to claim 1, wherein the threshold is set based on a maximum value of the amplitude which is obtained in such a situation that an error between the transfer function used by the reference signal generating unit and an actual transfer function from the speaker to the microphone does not occur.

6. The active vibration noise control device according to claim 5, wherein the threshold is at least larger than the maximum value, and a difference between the threshold and the maximum value is equal to or smaller than a predetermined value.

7. The active vibration noise control device according to claim 1, further including a unit which changes the threshold in accordance with the vibration noise frequency.

8. The active vibration noise control device according to claim 2, wherein the threshold is set based on a maximum value of the amplitude which is obtained in such a situation that an error between the transfer function used by the reference signal generating unit and an actual transfer function from the speaker to the microphone does not occur.

9. The active vibration noise control device according to claim 3, wherein the threshold is set based on a maximum value of the amplitude which is obtained in such a situation that an error between the transfer function used by the reference signal generating unit and an actual transfer function from the speaker to the microphone does not occur.

10. The active vibration noise control device according to claim 4, wherein the threshold is set based on a maximum value of the amplitude which is obtained in such a situation that an error between the transfer function used by the reference signal generating unit and an actual transfer function from the speaker to the microphone does not occur.

11. The active vibration noise control device according to claim 2, further including a unit which changes the threshold in accordance with the vibration noise frequency.

12. The active vibration noise control device according to claim 3, further including a unit which changes the threshold in accordance with the vibration noise frequency.

13. The active vibration noise control device according to claim 4, further including a unit which changes the threshold in accordance with the vibration noise frequency.

14. The active vibration noise control device according to claim 5, further including a unit which changes the threshold in accordance with the vibration noise frequency.

15. The active vibration noise control device according to claim 6, further including a unit which changes the threshold in accordance with the vibration noise frequency.

16. The active vibration noise control device according to claim 8, further including a unit which changes the threshold in accordance with the vibration noise frequency.

17. The active vibration noise control device according to claim 9, further including a unit which changes the threshold in accordance with the vibration noise frequency.

18. The active vibration noise control device according to claim 10, further including a unit which changes the threshold in accordance with the vibration noise frequency.

* * * * *